United States Patent [19]

Smith

[11] 4,021,290

[45] May 3, 1977

[54] BAG SEALER APPARATUS

[75] Inventor: Kevin R. Smith, Leawood, Kans.

[73] Assignee: Dazey Products Company, Kansas City, Mo.

[22] Filed: Aug. 16, 1976

[21] Appl. No.: 714,649

[52] U.S. Cl. ..... 156/510; 83/614; 156/583

[51] Int. Cl.[2] ..... B30B 15/34; B26D 5/08

[58] Field of Search ..... 156/510, 523, 583; 83/614

[56] References Cited

UNITED STATES PATENTS

| | | | |
|---|---|---|---|
| 560,294 | 5/1896 | Black | 83/614 |
| 3,671,357 | 6/1972 | Trouichet | 156/583 |

*Primary Examiner*—Douglas J. Drummond
*Attorney, Agent, or Firm*—Schmidt, Johnson, Hovey & Williams

[57] ABSTRACT

An improved bag-making and sealing device having a pair of spaced, upstanding, bag-locating and holding pins is provided which includes a low-cost, integral, synthetic resin pin-mounting assembly in the sealer base for biased, back-and-forth shifting movement of one of the pins in order to tightly hold a section of marginally apertured bag-making material during heat sealing operations. The sealer also includes a pivotally mounted pin assembly intermediate the relatively widely spaced main pins which is shiftable to an upright position for locating and holding a section of narrow bag-making material in cooperation with one of the widely spaced pins; when not in use, the intermediate pin is pivoted to a recessed, non-interfering storage position permitting normal heat sealing operations using standard width bag-making material. In preferred forms the base of the sealing device includes a cavity for holding a roll of tubular, two-ply, marginally apertured bag-making material, and a shiftable knife element mounted in the sealer base for cutting of the bag-making material after initial heat sealing operations are completed.

13 Claims, 10 Drawing Figures

BAG SEALER APPARATUS

This invention relates to an improved, low-cost bag-making and sealing device which is especially constructed for accommodating tubular, marginally apertured bag-making materials of different widths in order to make and seal different sized bags. More particularly, it is concerned with bag-making and sealing devices which include a pair of relatively widely spaced pin elements for locating and holding bag-making material of a standard width, along with an intermediate, pivotally mounted pin which can be selectively moved to an upstanding position for locating and holding a narrower bag-making material in conjunction with one of the remaining widely spaced pins. A particular feature of the sealer involves use of an integral, synthetic resin pin assembly serving to mount one pin element for back-and-forth shifting thereof and biasing the same in a direction for holding bag-making materials taut in relation to the material-engaging surfaces of the sealer.

In recent years household bag-sealing devices have achieved a large measure of consumer acceptance and success. Such units generally include a base section having an elongate heating element thereon, in conjunction with a lid hingedly secured to the base for opening and closing movement thereof. The lid also normally includes an elongate bag-engaging element which is located for cooperatively sealing an open ended bag or the like in conjunction with the heating element carried by the sealer base. Open ended bags are normally provided with the sealer, and are adapted to hold foods such as stews or the like for freezing. In practice, the housewife merely fills the storage bag with a desired food, and places the open end of the bag in engagement with the heating surface of the sealer base. At this point the lid section is shifted to its closed position so that the lid and base can cooperatively engage and heat seal the bag adjacent the open end thereof for safe food storage.

A number of bag sealers have been proposed in the past to serve the purposes outlined above. For example, coowned U.S. Pat. No. 3,847,712 discloses a bag sealer having a rotatable heating element presenting a pair of differently configured heating surfaces; this type of sealer is operable for sealing both conventional storage bags and so-called "boilable" bags which can be placed in boiling water to heat the food therein without opening of the bag. Another type of sealing apparatus which has achieved a wide degree of commercial acceptance is disclosed in co-owned U.S. Pat. application Ser. No. 759,584 filed Sept. 13, 1968. This application describes a sealer which includes a pair of spaced locating pins for a storage bag to be sealed in order to hold the bag taut during sealing operations. In this connection, the described sealer includes an upstanding pin element which is mounted for back-and-forth shifting movement, and which is biased in a direction away from the remaining stationary locating pin. This biasing action is provided by means of a helical spring connected to the pin element and the base of the sealer.

However, bag sealers of the type described suffer from a number of deficiencies. For example, these prior units are in general able to accommodate only a single width of bag, since the pin elements provided therewith are essentially fixed relative to each other. Moreover, since the bags provided with such units are of fixed dimensions in length as well as in width, it will be appreciated that in many instances bags usable with the sealers will be either too big or too small for a given use.

Another problem involves the cost of providing biased-apart pin assemblies for holding a sealable bag in a taut condition during sealing. That is, conventional springs and related structure normally used for this purpose are relatively expensive to produce and install, and therefore any pin-biasing assembly which reduces these costs can amount to a decided advantage, especially in the highly competitive small appliance field.

It is therefore the most important object of the present invention to provide a bag-making and sealing device which is especially constructed for accommodating bag-making materials of different widths by provision of spaced, upstanding pin means which are configured for insertion into corresponding, complemental apertures provided in the side margins of bag-making material of a relatively wide standard width, in conjunction with a shiftable intermediate pin which can be shifted to an upstanding, bag-locating and holding position for securing narrower bag-making material in position adjacent the material-engaging surfaces of the sealer in conjunction with one of the pair of widely spaced pins.

Another aim of the invention is to provide a bag sealer of the type described which includes a pin mounted for back-and-forth shifting movement on the sealer base, and which is biased in a direction away from the remaining pins for holding bag-engaging material taut and in proper relationship to the material-engaging surfaces of the sealer; the pin mounting assembly hereof preferably includes an elongated strap of resilient synthetic resin material which is integrally constructed with the upstanding pin element and has the outermost end thereof in operative engagement with the sealer base for biasing the pin element away from the remaining pins.

Another aim of the invention is to provide a sealer having the base section thereof especially configured to present a cavity adapted to receive a rotatable roll of bag-making material comprising a pair of opposed synthetic resin webs interconnected along the side marginal edges thereof to present a tubular, two-sheet construction, with each of the connected side margins having a plurality of apertures therein for receiving pin elements supported on the base section, so that essentially any desired length of bag-making material can be unrolled and placed in sealing disposition over the pins to form a bag of desired dimensions.

As a corollary to the foregoing, another aim of the invention is to provide the roll-receiving base of the sealer with structure defining an elongate knife track adjacent the base heat sealing element, in conjunction with knife means shiftably positioned in the track; in this fashion bag-making material can be cut at a desired length subsequent to the initial sealing operation by simply shifting the knife element along the track to cut the material, whereupon the resultant bag can be filled with food and resealed.

IN THE DRAWING

Figure 1:
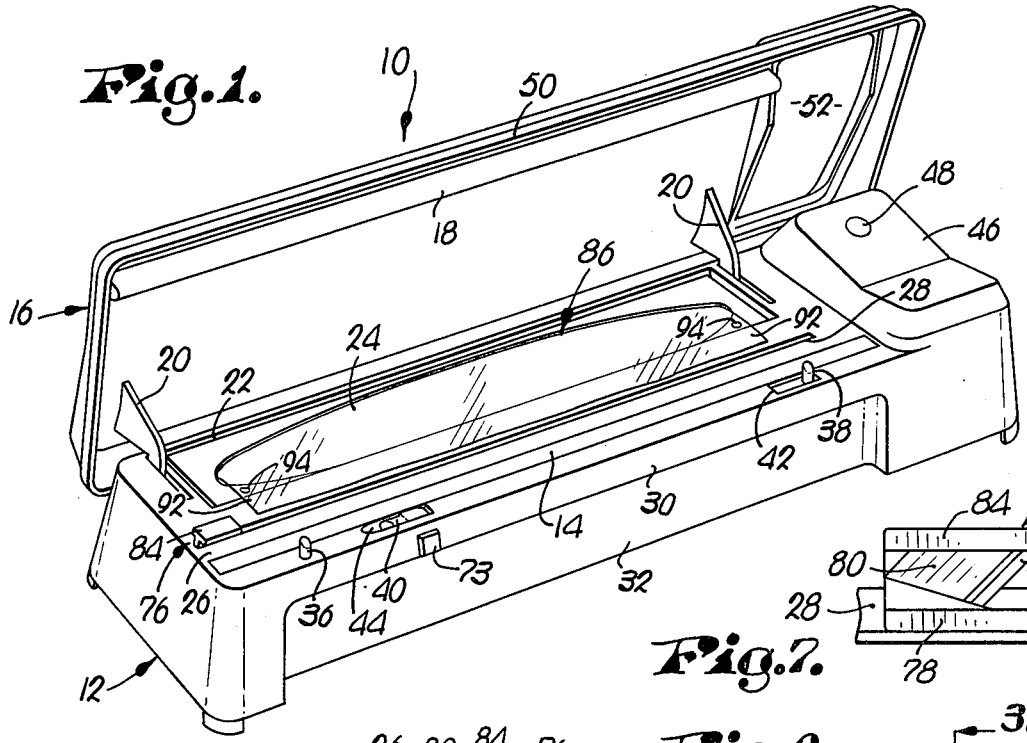
FIG. 1 is a perspective view of a bag-sealing device in accordance with the invention, shown with a roll of standard-width bag-making material disposed within the cavity provided therefor.

Turning now to the drawing, sealing apparatus 10 broadly includes a base section 12 having an elongate, material-engaging and heating element 14 thereon, and a hingedly mounted lid section 16 which carries an elongate, flexible member 18 which presents a second material-engaging surface. In the usual fashion, lid section 16 is hingedly mounted to base section 12 by means of spaced arms 20 pivotally secured to base section 12, so that lid section 16 can be alternately moved to the open position illustrated permitting positioning of bag-making material between the sections, and a closed, sealing position wherein element 14 and the surface presented by member 18 are oppositely disposed for engagement with the opposite sides of a section of bag-making material.

In more detail, base section 12 is preferably formed of synthetic resin material and presents an elongate, generally rectangular opening or cavity 22 therein which is adapted to hold a roll of bag-making material 24 to be described in detail hereinafter. In addition, base 12 is configured to present a generally planar platform section 26 adjacent to and extending forwardly from cavity 22. Platform section 26 is configured to present an elongated slot or knife track 28, and also supports elongate heating element 14. The forwardmost edge of platform section 26 terminates in a depending lip 30 as shown. A recessed front wall 32 depends from the underside of platform section 26 and defines, in cooperation with lip 30, an elongate recessed area 34.

Figure 2:
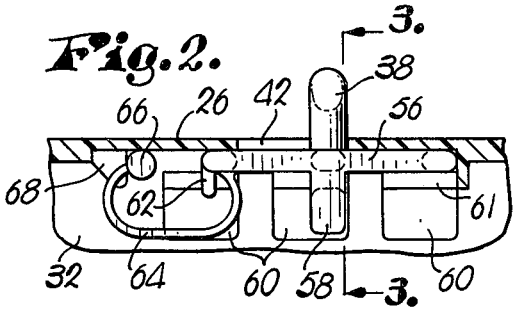
FIG. 2 is an enlarged, fragmentary view in vertical section illustrating in detail the construction of the biased back-and-forth shiftable pin assembly supported by the base of the sealing device.
Figure 5:
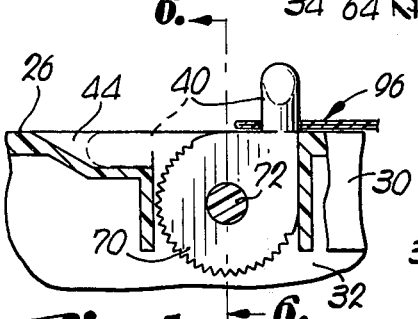
FIG. 5 is an enlarged, fragmentary view in vertical section showing the construction of the pivotal pin assembly located intermediate the widely spaced pins.

First, upstanding, stationary pin means 36 is supported by section 26 adjacent the left hand end of element 14 as viewed in FIG. 1. In addition, second, upstanding, shiftable pin means 38 is supported on base section 12 adjacent the opposite end of element 14. Finally, pivotal pin means 40 is provided in section 12 intermediate the first and second pin means 36 and 38. As best seen in FIGS. 1, 2 and 5, platform section 26 is slotted as at 42 for receiving upstanding second pin means 38, and is configured to present a recess 44 for receiving pin means 40 when the same is shifted to its noninterfering, laterally extending position as will be explained.

The right hand end of base section 12 houses conventional electrical means for delivering current to element 14, and includes an upstanding shell section 46 having an indicator light 48 thereon which, in the usual manner, lights during operation of apparatus 10.

Lid section 16 is of essentially conventional construction and includes a marginal, depending forward lip 50 in spaced relationship to member 18 in order to define a recessed, pin-receiving area allowing the lid section 16 to fully close and clear the respective pin means 36, 38 and 40. Moreover, the right hand end of lid section 16 is configured to present an opening 52 which complementally receives upstanding shell section 46 of the base to permit lid closing.

Material-engaging and heating element 14 is of conventional construction and includes an elongate resistance heating wire 54 extending along the length thereof. In the known manner, current is delivered to wire 54 for producing the necessary heat to seal a plastic bag or the like in engagement therewith.

Figure 3:
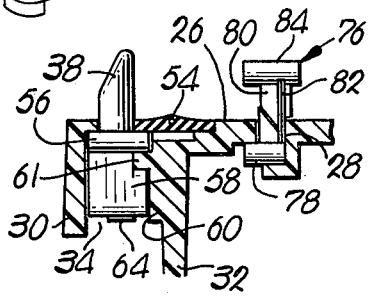
FIG. 3 is a vertical sectional view taken along line 3—3 of FIG. 2 and further illustrating the construction of the shiftable pin assembly.
Figure 4:
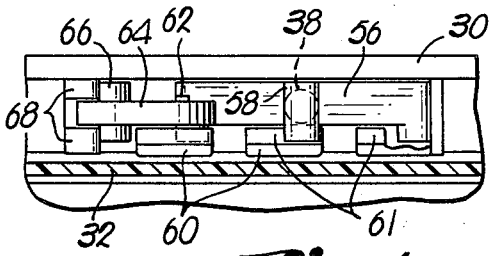
FIG. 4 is a bottom plan view partially in section and with parts broken away for clarity illustrating the shiftable pin assembly depicted in FIGS. 2–3.

Referring now to FIGs. 2–4, the specific construction of second pin means 38, and the structure supporting the same, will be described in detail. Specifically, upstanding pin means 38 is supported on an elongate, slidable base member 56 which has a depending guide lug 58 connected thereto. As best seen in FIG. 3, lug 58 is of sufficient width to substantially span the distance between lip 30 and front wall 32, in order to guide the back-and-forth shifting of pin means 38. For this purpose, wall 32 is provided with three outwardly extending, spaced bearing wall areas 60 which engage the innermost face of lug 58 during shifting of pin means 38 for proper guiding of the latter. The wall areas 60 also include outwardly extending track-defining members 61 which provide additional support and guidance for base member 56.

The left hand end of base member 56 includes a depending projection 62, and forms one end of arcuate, generally C-shaped strap 64. The latter includes a transversely extending cylindrical block 66 at the remaining end thereof which is adapted to engage base 12. For this purpose, the underside of platform section 26 is provided with a pair of spaced, depending stop arms 68 which receive therebetween the end of strap 64 and engage cylindrical block 66.

Pin means 38, base member 56, lug 58, projection 62, strap 64 and block 66 are preferably integrally formed of a conventional, resilient synthetic resin material such as the commercially available product sold under the name "Delrin". As will be appreciated from a study of FIG. 2, shifting of pin means 38 to the left occurs in opposition to the configuration of resilient C-shaped strap 64, so that a biasing force is generated for urging pin means 38 to the right, or in a direction away from the remaining pin means 36 and 40. This result obtains from the arcutate configuration of the strap 64, as well as the resilience and inherent "memory" thereof. Furthermore, excessive shifting to the left of pin means 38 is prevented by means of depending projection 62. Specifically, projection 52 prevents cylindrical block 66 from working itself between the upper surface of base member 56 and the adjacent underside of the wall defining platform section 26.

In any event, it is especially significant that biased, back-and-forth shifting of pin means 38 is accomplished without the use of expensive helical springs and the like conventionally used for this purpose. Provision of an overall pin assembly of integral, synthetic resin construction permits easy, relatively inexpensive fabrication and installation thereof, as compared with prior methods.

Figure 6:
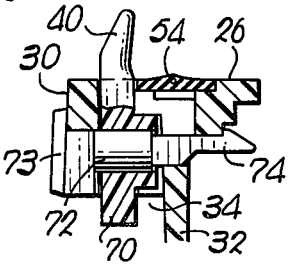
FIG. 6 is a vertical sectional view taken along line 6—6 of FIG. 5 and further illustrating the pivotal pin assembly.

Third pin means 40 located between the relatively widely spaced pin means 36 and 38 is mounted for pivotal movement thereof as best illustrated in FIG. 5. Specifically, pin means 40 is an integral member which includes a generally circular, peripherally toothed rotation segment 70 which is located within recessed area 34. A specially configured pivot pin 72 extends through an opening provided in the underside of lip 30 and the central aperture in rotation segment 70. Pin 72 also includes an outermost connection block 73 and an inwardly extending latch segment 74 which extends through an appropriate aperture in front wall 34 and engages a depending surface of the generally horizontally disposed wall presenting platform section 26 (see FIG. 6).As best seen in FIG. 6, the lower portion of segment 70 extends below lip 30 to facilitate manual rotation of segment 70 and thus pin means 40.

As will be appreciated from the foregoing, pin means 40 is pivotal between a generally laterally extending, noninterfering storage position depicted in phantom in FIG. 5, and an upstanding, bag-locating and holding position illustrated in bold lines.

Figure 7:
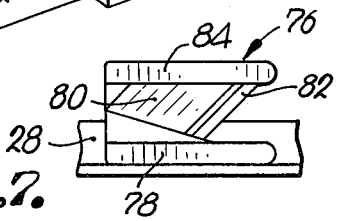
FIG. 7 is an enlarged, fragmentary view depicting the construction of the shiftable knife element provided with the sealer base.

Knife means generally referred to by the numeral 76 is disposed within track 28 and includes a generally rectangular base 78 in engagement with the bottom defining surface of the track. An upstanding, knife-supporting element 80 is connected to base 78 and extends above the level track 28. Element 80 supports a cutting blade 82 which presents an oblique cutting edge (see FIG. 7). Finally, an uppermost, generally rectangular cap 84 is connected to knife-supporting element 80 for permitting easy, safe, back-and-forth shifting of knife means 76 during cutting operations.

Figure 8:
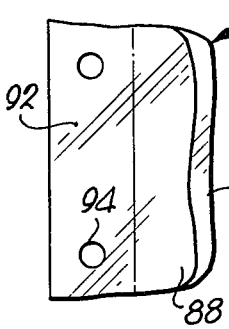
FIG. 8 is a fragmentary plan view of the two-sheet, tubular, marginally bound and apertured bag-making material preferably used in conjunction with the sealing apparatus hereof.

The bag-making material 86 preferably used in conjunction with apparatus 10 is fragmentarily shown in FIG. 8 and includes a pair of synthetic resin sheets 88 and 90 which are bonded together adjacent the respective sides thereof. This construction presents a tubular, open ended bag-making material bounded on opposite sides by a connected, two-ply margin 92. Each of the side margins 92 is configured to present a plurality of longitudinally spaced pin-receiving apertures 94. In preferred forms, material 86 is in the form of a rotatable roll 24 (see FIG. 1) positioned within cavity 22 of base section 12.

During use of apparatus 10 in making and sealing a standard width food storage bag, a simple procedure is followed. First, a desired length of bag-making material of the standard width illustrated in FIG. 1 is unrolled, whereupon the relatively widely spaced pin means 36 and 38 are inserted into the appropriate marginal bag apertures. This has the effect of locating a section of the bag-making material between pin means 36 and 38 adjacent to heating element 14. Any looseness or the like due to imperfect construction of the bag-making material is taken up by means of biased pin assembly 38, so that the bag-making material is stretched taut across the element 14. At this point lid section 16 is closed against base section 12 so that the surface presented by member 18, and element 14, are oppositely disposed and in engagement with the opposite surfaces of material 86. Heating element 14 is then energized (either through a conventional manual or automatic lid-operated switch) in order to heat and seal the bag-making material. The next step involves shifting knife means 76 from left to right as viewed in FIG. 1 for cutting the bag-making material adjacent the newly formed transverse seal, in order to present an open-ended bag. The housewife next fills the formed bag with a desired food such as a stew of the like, whereupon the remaining open end of the bag is sealed. This involves simply placing the appropriate marginal bag apertures over the pin means 36 and 38, shifting lid section 16 to its bag-engaging position, and causing element 14 to heat.

If it is desired to use apparatus 10 for making a bag from a narrower bag-making material, the following procedure is followed. First, intermediate pin means 40 is shifted to the upright position thereof illustrated in FIGS. 5 and 6 simply by manipulating the exposed portion of rotation segment 70. At this point the narrower bag-making material 96 (which is identical in all respects save for the width thereof to material 86) is unrolled to the desired length, whereupon pin means 40 and 38 are inserted into the marginal bag apertures provided adjacent the point corresponding to the length of the desired bag. The remaining steps outlined above are then followed to first make, fill, and finally seal the food storage bag. Of course, if it is again desired to utilize apparatus 10 for making standard-width bags, it is only necessary to shift pin means 40 to the recessed position thereof where no interference is presented to use of the relatively widely spaced main pin means 35 and 38.

Figure 10:
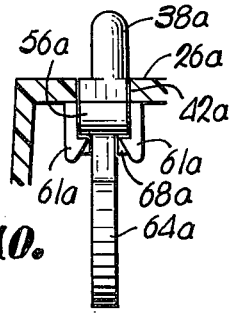
FIG. 10 is a vertical sectional view taken along line 10—10 of FIG. 9 and further illustrating the alternate pin assembly.
Figure 9:
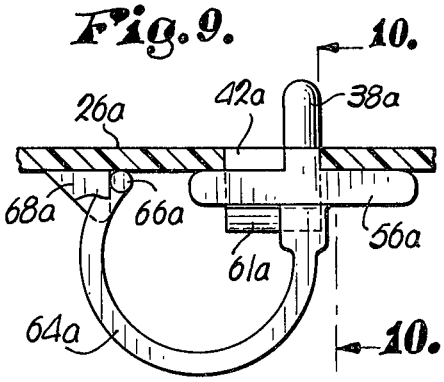
FIG. 9 is a fragmentary view in vertical section of an alternate embodiment of the biased, shiftable pin assembly provided with the sealer base.

An alternate embodiment for second pin means 38 is depicted in FIGS. 9 and 10 and is referred to as pin means **38*a*. The latter is in most respects similar to the first-described embodiment, and includes a base section 56*a* supported between appropriate, depending, track-defining elements 61*a* for shifting, back-and-forth movement of pin means 38*a*. Track-defining elements 61a are connected to the generally horizontally disposed wall presenting platform surface 26*a*, with the wall being slotted as at 42*a*. Strap 64*a* is generally and partially circular in configuration and extends from base member 56*a* and terminates in a transversely extending stop block 66*a*. A pair of spaced, depending stop amrs 68*a* extend from the underside of the wall defining the platform surface, and these receive therebetween the end of strap 64*a* and engage block 66*a*. Pin means 38*a* is integral with base 56*a*, strap 64*a* and block 66*a* and is preferably formed of resilient synthetic resin material such as the Delrin plastic. Moreover, the the operation thereof is identical with that described in connection with pin means 38. Thus, pin means 38a is effective for providing the desirable biased, back-and-forth shifting described in connection with pin means 38.**

Having thus described the invention, what is claimed as new and desired to be secured by Letters Patent is:

1. Apparatus for making and sealing bags or the like, comprising:

a base section presenting a first elongate material-engaging surface;

a closure section presenting a second elongate material-engaging surface;

means mounting said closure section for movement thereof between a material-engaging position where said first and second material-engaging surfaces are oppositely disposed for engagement with the opposite sides of a section of bag-making material, to an open position permitting positioning of bag-making material between the sections;

means for heating at least one of said material-engaging surfaces;

first upstanding pin means supported by said base and located adjacent said first material-engaging surface;

second pin means in spaced relationship to said first pin means and located adjacent said first material-engaging surface; and means shiftably mounting said second pin means on said base section for back-and-forth movement of said second pin means relative to said first pin means, and for biasing said second pin means in a direction away from said first pin means, said shiftable mounting means including an elongated strap member formed of resilient synthetic resin material and having one end thereof operatively coupled to said pin means and the other end thereof operatively coupled to said base section, said first and second pin means which being configured for insertion into corresponding complemental apertures provided in the opposite margins of bag-making material for locating and holding said bag-making material relative to said material-engaging surfaces during sealing operations when said sections are in said material-engaging disposition.

2. Apparatus as set forth in claim 1 wherein said strap member is of arcuate configuration.

3. Apparatus as set forth in claim 2 wherein said strap member is generally and partially circular in configuration.

4. Apparatus as set forth in claim 2 wherein said strap member is generally C-shaped in configuration.

5. Apparatus as set forth in claim 1 wherein said strap member is integral with said pin means, with said other end of said strap member in engagement with said base section.

6. Apparatus as set forth in claim 1 including shiftable knife means carried by said base section for cutting said bag-making material after said sealing operations are completed.

7. Apparatus as set forth in claim 6 wherein said knife means is provided adjacent to the bag-engaging surface of said one section and is shiftable along the length thereof.

8. Apparatus for making and sealing bags or the like, said apparatus being constructed for accommodating bag-making material of different widths in order to make and seal bags of different widths, said apparatus comprising:

a base section presenting a first elongate material-engaging surface;

a closure section presenting a second elongate material-engaging surface;

means mounting said closure section for movement thereof between a material-engaging position where said first and second material-engaging surfaces are oppositely disposed for engagement with the opposite sides of a section of bag-making material, to an open position permitting positioning of bag-making material between the sections;

means for heating at least one of said material-engaging surfaces;

spaced first and second upstanding pin means supported by said base section adjacent the material-engaging surface thereof and respectively configured for insertion into corresponding complemental apertures provided in the opposite margins of bag-making material of a first width, for locating and holding said bag-making material of said first width relative to said sections during sealing operations;

third upstanding pin means supported by said base and located adjacent the material-engaging surface thereof between said first and second pin means; and means shiftably mounting said third pin means for movement thereof between an upstanding position and a lowered storage position, said third pin means in the upstanding position thereof, and one of said first and second pin means, each being insertable into corresponding complemental apertures provided in the opposed margins of bag-making material of a second width less than said first width, in order to locate and hold said bag-making material of said second width relative to said material-engaging surfaces during sealing operations when said sections are in said materialengaging disposition.

9. Apparatus as set forth in claim 8 wherein said means shiftably mounting said third pin means includes structure pivotally mounting the third pin for selective movement thereof between said upstanding position and a noninterfering storage position.

10. Apparatus as set forth in claim 9 wherein said base section is configured to present a recess adjacent said third pin means for receiving the latter when the third pin means is shifted to a laterally extending storage position.

11. Apparatus as set forth in claim 9 wherein said pivotal mounting structure comprises a peripherally toothed rotation segment connected to and supporting said pin means, and means pivotally coupling said rotation segment to said base section with at least a portion of the toothed periphery of said rotation segment exposed for ease of manual manipulation.

12. Apparatus as set forth in claim 8 including structure mounting one of said first and second pin means for lateral back-and-forth shifting movement thereof.

13. Apparatus as set forth in claim 12 wherein said back-and-forth mounting structure includes means biasing said one pin means in a direction away from the other of said first and second pin means.

* * * * *